US010100595B2

(12) United States Patent
Nguyen et al.

(10) Patent No.: US 10,100,595 B2
(45) Date of Patent: Oct. 16, 2018

(54) HANGER SEAL ASSEMBLY

(71) Applicant: Cameron International Corporation, Houston, TX (US)

(72) Inventors: Dennis P. Nguyen, Pearland, TX (US); Jose Roberto Navar, Houston, TX (US)

(73) Assignee: Cameron International Corporation, Houston, TX (US)

( * ) Notice: Subject to any disclaimer, the term of this patent is extended or adjusted under 35 U.S.C. 154(b) by 134 days.

(21) Appl. No.: 14/836,816

(22) Filed: Aug. 26, 2015

(65) Prior Publication Data

US 2017/0058622 A1 Mar. 2, 2017

(51) Int. Cl.
*E21B 33/04* (2006.01)
*E21B 23/00* (2006.01)

(52) U.S. Cl.
CPC ..... *E21B 33/04* (2013.01); *E21B 23/00* (2013.01)

(58) Field of Classification Search
CPC .. E21B 33/04; E21B 2033/005; E21B 33/043; E21B 33/0415; E21B 23/02
USPC ... 166/75.14, 85.3, 208, 322, 338, 345, 348, 166/379, 196, 382
See application file for complete search history.

(56) References Cited

U.S. PATENT DOCUMENTS 5,325,925 A * 7/1994 Smith ..... E21B 33/04 166/196
8,944,156 B2 2/2015 Keat et al.
2011/0226488 A1 9/2011 Garcia
2012/0067597 A1 3/2012 Lang et al.
2012/0205123 A1* 8/2012 Kennedy ..... E21B 47/1025 166/382

FOREIGN PATENT DOCUMENTS

WO 9204526 A1 3/1992

OTHER PUBLICATIONS

International Search Report dated Feb. 17, 2017, for International Application No. PCT/US2016/058446.
International Preliminary Report on Patentability dated Feb. 27, 2018, for International Application No. PCT/US2016/058446 (11 pgs).

* cited by examiner

*Primary Examiner* — Carib A Oquendo
(74) *Attorney, Agent, or Firm* — Conley Rose, P.C.

(57) ABSTRACT

A tubing or casing hanger seal assembly is disclosed including an actuation sleeve to be mounted on a tubing hanger, a shoulder member to be mounted on the tubing hanger, and a seal assembly disposed between the actuation sleeve and the shoulder member. The seal assembly includes a first set or pair of seals engaged at a tapered interface, and a second set or pair of seals engaged at a tapered interface. Radial sectional areas can differ between seals of the seal pairs. Further, the first set of seals can be coupled to the second set of seals such that the first and second sets of seals are energized by the same setting motion of the actuation sleeve.

23 Claims, 9 Drawing Sheets

HANGER SEAL ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling and production systems require various components to access and extract hydrocarbons from subterranean earthen formations. Such systems generally include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers are disposed or received within a spool, housing, or bowl. In addition to suspending strings inside the wellhead assembly, the hangers provide sealing to seal the interior of the wellhead assembly and strings from pressure inside the wellhead assembly. Pressure from above or below the hanger may cause movement of the hanger in the wellhead. Hanger movement may put pressure on other components, such as landing shoulders or seals. Thus, hanger sealing and stability provides a foundation for proper operations of other portions of the wellhead assembly.

SUMMARY

In some embodiments, a tubing or casing hanger seal assembly includes an actuation sleeve to be mounted on a tubing hanger, a shoulder member to be mounted on the tubing hanger, a seal assembly disposed between the actuation sleeve and the shoulder member, the seal assembly including a first set of seals engaged at a tapered interface, and a second set of seals engaged at a tapered interface, wherein, for each set of seals, a first radial plane across the set of seals and the tapered interface includes a radial sectional area of a first seal greater than a radial sectional area of a second seal, and a second radial plane across the set of seals and the tapered interface includes a radial sectional area of the second seal greater than a radial sectional area of the first seal. The actuation sleeve may be actuatable to energize the first and second sets of seals in a single setting motion. A load pathway may extend from the actuation sleeve to the first set of seals, from the first set of seals directly to the second set of seals, and from the second set of seals to the shoulder member. The shoulder member may include tapered shoulders to engage the second set of seals. The seal assembly may further include a tubing hanger and a hanger receptacle in a wellhead that receives the tubing hanger, wherein the actuation sleeve, the shoulder member, and the seal assembly are disposed on the tubing hanger to capture the seal assembly between the tubing hanger and the hanger receptacle.

In certain embodiments, the first set of seals comprises a first seal in contact with a second seal at the first tapered interface, the second set of seals comprises a third seal in contact with a fourth seal at the second tapered interface, the first radial plane across the first seal, the second seal and the first tapered interface includes the radial sectional area of the first seal greater than the radial sectional area of the second seal, the second radial plane across the first seal, the second seal and the first tapered interface includes the radial sectional area of the second seal greater than the radial sectional area of the first seal, the first radial plane across the third seal, the fourth seal and the second tapered interface includes the radial sectional area of the third seal greater than the radial sectional area of the fourth seal, and the second radial plane across the third seal, the fourth seal and the second tapered interface includes the radial sectional area of the fourth seal greater than the radial sectional area of the third seal.

In some embodiments, a tubing or casing hanger seal assembly includes an actuation sleeve to be mounted on a tubing hanger and to provide a setting motion, a shoulder member to be mounted on a tubing hanger, a seal assembly disposed between the actuation sleeve and the shoulder member, the seal assembly including a first set of seals engaged at a tapered interface, and a second set of seals engaged at a tapered interface, wherein the first set of seals is coupled to the second set of seals such that the first and second sets of seals are energized by the same setting motion of the actuation sleeve. The seal assembly may include a seal engagement interface disposed between the first and second sets of seals to directly transfer the setting motion from the first set of seals to the second set of seals. The seal assembly may further include a support member coupled between the first and second sets of seals. The seal assembly may include a load pathway extending from the first set of seals through the second set of seals.

In some embodiments, a method of actuating a tubing or casing hanger seal assembly includes lowering a tool, sleeve, and seal assembly into a wellhead, receiving the tool, sleeve, and seal assembly in a hanger receptacle in the wellhead, actuating the tool to move the sleeve, and energizing a first set of seals and a second set of seals in the seal assembly with the same sleeve movement. The first set of seals may be an upper set of seals adjacent the sleeve, and the second set of seals may be a lower set of seals disposed below the upper seals. The method may include energizing the lower seals before, or at the same time as, the upper seals. The method may include energizing the lower seals against a tapered shoulder. The method may include using a setting force to set the upper and lower seals, and wherein setting the lower seals uses less of the setting force than setting the upper seals. A seal of the first set of seals may energize a seal of the second set of seals across a seal engagement interface between the seals. The method may include each of the first and second sets of seals having a pair of seals with a tapered sliding interface therebetween, and sliding the seals in substantially the same direction. A force applied from above and below each of the first and second sets of seals may provide a sealing pressure enhancement above and below each of the first and second sets of seals.

BRIEF DESCRIPTION OF THE DRAWINGS

For a detailed description of exemplary embodiments, reference will now be made to the accompanying drawings in which.

DETAILED DESCRIPTION

Figure 1:
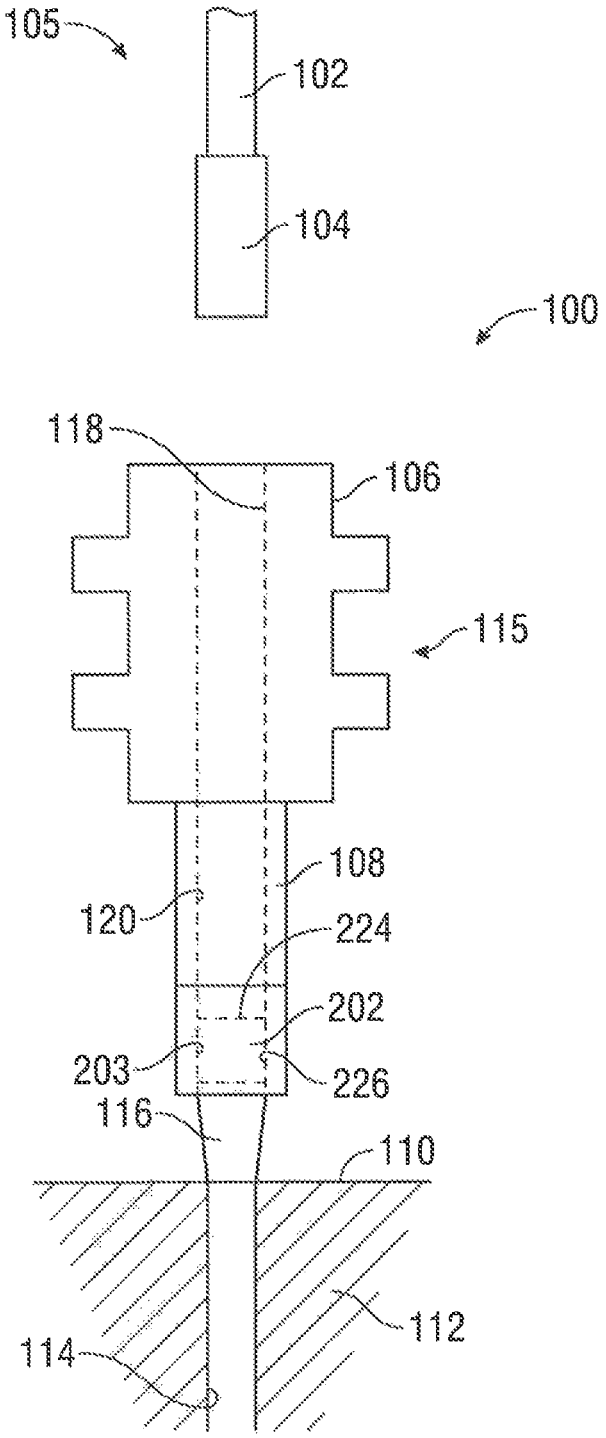
FIG. 1 is a schematic view of an embodiment of a wellhead system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 100. The well system 100 can be configured to extract various minerals and natural resources, including hydrocarbons (e.g., oil and/or natural gas), or configured to inject substances into an earthen surface 110 and an earthen formation 112 via a well or wellbore 114. In some embodiments, the well system 100 is land-based, such that the surface 110 is land surface, or subsea, such that the surface 110 is the seal floor. The system 100 includes a wellhead 115 that can receive a tool or tubular string conveyance 105. The wellhead 115 is coupled to a wellbore 114 via a wellhead connector or hub 116. The wellhead 115 typically includes multiple components that control and regulate activities and conditions associated with the well 114. For example, the wellhead 115 generally includes bodies, valves and seals that route produced fluids from the wellbore 114, provide for regulating pressure in the wellbore 114, and provide for the injection of substances or chemicals downhole into the wellbore 114.

In the embodiment shown, the wellhead 115 includes a Christmas tree or tree 108, a tubing and/or casing spool 202, and a tubing and/or casing hanger 224. For ease of description below, reference to "tubing" shall include casing and other tubulars associated with wellheads. Further, "spool" may also be referred to as "housing" or "receptacle." A blowout preventer (BOP) 106 may also be included, either as a part of the tree 108 or as a separate device. The BOP 106 may includes of a variety of valves, fittings, and controls to prevent oil, gas, or other fluid from exiting the wellbore 114 in the event of an unintentional release of pressure or an overpressure condition. The system 100 may include other devices that are coupled to the wellhead 115, and devices that are used to assemble and control various components of the wellhead 115. For example, in the illustrated embodiment, the system 100 includes a tool conveyance 105 including a tool 104 suspended from a tool or drill string 102. In certain embodiments, the tool 104 includes a running tool that is lowered (e.g., run) from an offshore vessel to the well 114 and/or the wellhead 115. In other embodiments, such as land surface systems, the tool 104 may include a device suspended over and/or lowered into the wellhead 115 via a crane or other supporting device.

The tree 108 generally includes a variety of flow paths, bores, valves, fittings, and controls for operating the well 114. The tree 108 may provide fluid communication with the well 114. For example, the tree 108 includes a tree bore 120. The tree bore 120 provides for completion and workover procedures, such as the insertion of tools into the well 114, the injection of various substances into the well 114, and the like. Further, fluids extracted from the well 114, such as oil and natural gas, may be regulated and routed via the tree 114. As is shown in the system 100, the tree bore 120 may fluidly couple and communicate with a BOP bore 118 of the BOP 106.

The tubing spool 202 provides a base for the tree 108. The tubing spool 202 includes a tubing spool bore 203. The tubing spool bore 203 fluidly couples to enable fluid communication between the tree bore 120 and the well 114. Thus, the bores 118, 120, and 203 may provide access to the wellbore 114 for various completion and workover procedures. For example, components can be run down to the wellhead 115 and disposed in the tubing spool bore 203 to seal off the wellbore 114, to inject fluids downhole, to suspend tools downhole, to retrieve tools downhole, and the like.

As one of ordinary skill in the art understands, the wellbore 114 may contain elevated pressures. For example, the wellbore 114 may include pressures that exceed 10,000 pounds per square inch (PSI). Accordingly, well systems 100 employ various mechanisms, such as mandrels, seals, plugs and valves, to control and regulate the well 114. For example, the tubing hanger 224 is typically disposed within the wellhead 115 to secure tubing and casing suspended in the wellbore 114, and to provide a path for hydraulic control fluid, chemical injections, and the like. The hanger 224 includes a hanger bore 226 that extends through the center of the hanger 224, and that is in fluid communication with the tubing spool bore 203 and the wellbore 114.

Figure 2:
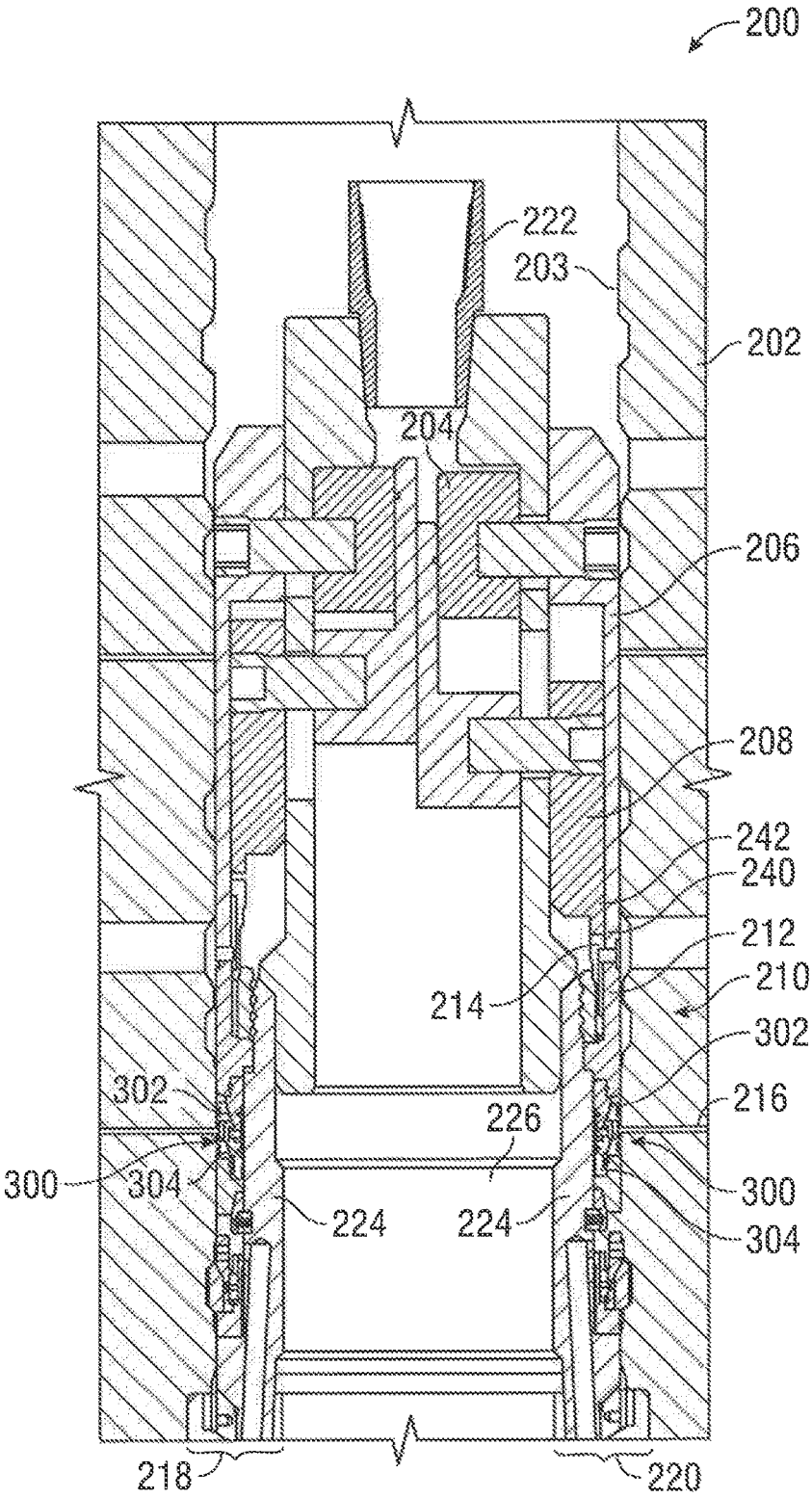
FIG. 2 is a cross-sectional view of an embodiment of a tubing or casing hanger system of FIG. 1 in accordance with principles disclosed herein.

Referring now to FIG. 2, a cross-section view of the tubing spool 202 of FIG. 1 is shown. Disposed inside the tubing spool 202 is a hydraulic tool 204 and tubing hanger 224 assembly, thus forming the major components of a hanger system 200. In some embodiments, the hydraulic tool 204 includes other actuation tools, and the tubing hanger 224 includes casing and other tubular string hangers. The hydraulic tool 204 includes an actuation head 222, an outer sleeve actuator 206, and an inner sleeve actuator 208. Disposed below the hydraulic tool 204 is a sleeve and seal assembly 210, including an outer sleeve 212, an inner sleeve 214, and a seal assembly 300. The seal assembly 300 includes a first or upper set of seals 302 and a second or lower set of seals 304. Accordingly, the sleeve and seal assembly 210 and the seal assembly 300 may also be referred to as a "dual seal" assembly or a "dual metal seal" assembly. The seal assembly 300, when set as more fully described below, seals between the tubing hanger 224 and the tubing spool 202. A port 216 in the tubing spool 202 allows fluid communication with the seal assembly 300, such as for fluid pressure testing. The tubing hanger 224 includes a central bore 226. A first or run-in position of the hydraulic tool 204 and sleeve and seal assembly 210 is shown at 218, and a second or set position of the hydraulic tool 204 and sleeve and seal assembly 210 is shown at 220. These positions will be described more fully below.

Figure 3:
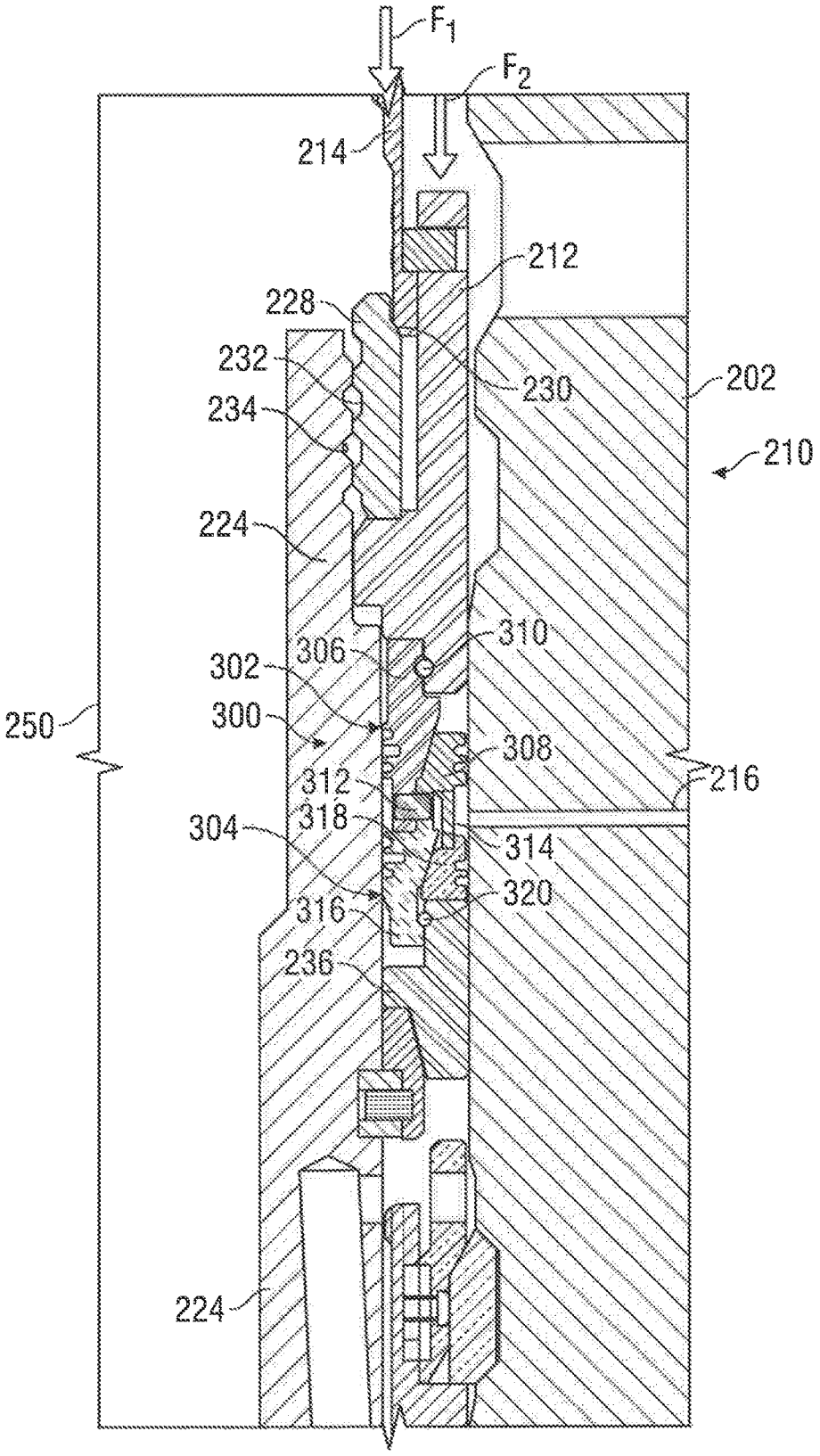
FIG. 3 is a cross-sectional, enlarged view of an embodiment of a sleeve and seal assembly of FIG. 2 in a run-in position.

Referring next to FIG. 3, an enlarged view of the sleeve and seal assembly 210 is shown in the run-in position 218. The inner sleeve 214 is retained at the upper end of the sleeve and seal assembly 210 and engages a retainer or load ring 228 at an interface 230. The load ring 228 includes an engagement profile 232 that can matingly engage with an engagement profile 234 on the tubing hanger 224. The outer sleeve 212 is disposed in a radial direction between the tubing hanger 224/load ring 228 and the tubing spool 202. Unless otherwise noted, "axial" or "axially" refers to the direction generally along a longitudinal axis 250 of the hanger system 200, and "radial" or "radially" refers to the direction generally normal or perpendicular to the axis 250. Thus, for example, the tubing hanger 224, the load ring 230, the inner sleeve 214, the outer sleeve 212, and the tubing spool 202 generally progress radially outwardly from the axis 250 of the hanger system 200.

The outer sleeve 212 engages a first or inner seal 306 of the seal set 302, with a retainer wire or member 310 disposed between the outer sleeve 212 and the inner seal 306. The seal set 302 also includes a second or outer seal 308. The seal set 304 includes a first or inner seal 316 and a second or outer seal 318. A pin 312, such as a dowel pin, or other retainer member or set of retainers is disposed axially between the inner seals 306, 316. In some embodiments, the pin 312 connects or retains the inner seals 306, 316 relative to each other. A leg or other support member 314 is disposed axially between the outer seals 308, 318. In some embodiments, the support leg 314 provides a reactive axial supporting force between the outer seals 308, 318. The inner seal 316 is retained relative to a shoulder member 236 by a retainer wire or member 320.

Figure 4:
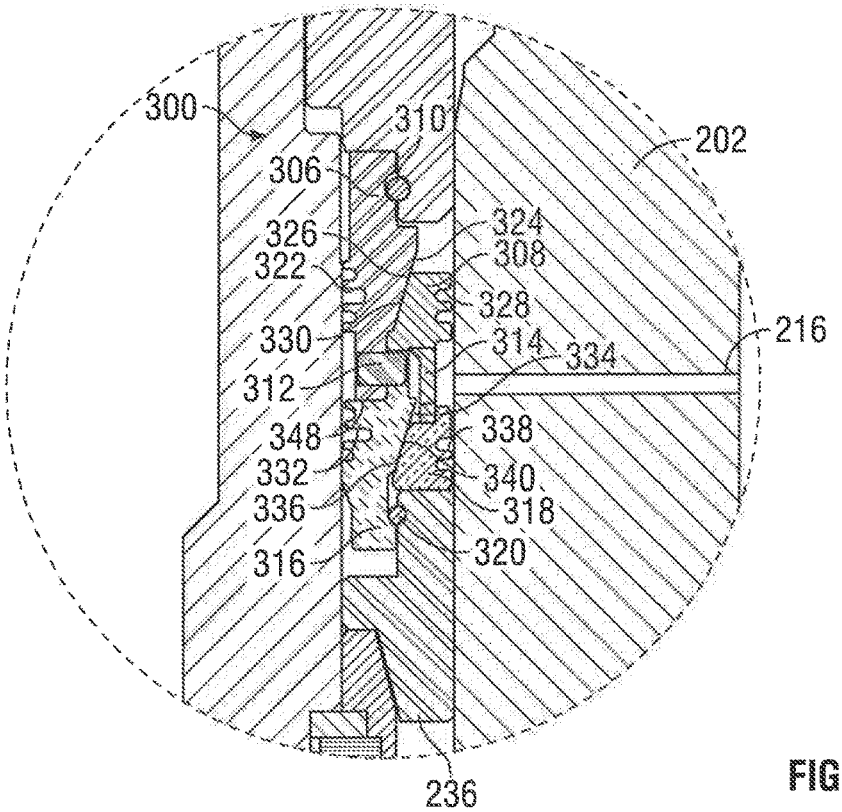
FIG. 4 is an enlarged view of a seal assembly of FIGS. 2 and 3.

Referring next to FIG. 4, an enlarged view of the seal assembly 300 is shown. The first seal 306, or upper and inner seal 306, includes an inner sealing profile 322 and an outer sliding surface 324 that is tapered or angled. The second seal 308, or upper and outer seal 308, includes an outer sealing profile 328 and an inner sliding surface 326 that is tapered or angled. The tapered seal surfaces 324, 326 mate to form a tapered or angled seal interface 330. The first seal 316, or lower and inner seal 316, includes an inner sealing profile 332 and an outer sliding surface 334 that is tapered or angled. The second seal 318, or lower and outer seal 318, includes an outer sealing profile 338 and an inner sliding surface 336 that is tapered or angled. The tapered seal surfaces 334, 336 mate to form a tapered or angled seal interface 340. In some embodiments, the tapered seal interfaces 330, 340 are angled in substantially the same direction relative to the system axis 250. In some embodiments, the tapered seal interfaces 330, 340 are parallel. Between the upper, inner seal 306 and the lower, inner seal 316 is an engagement interface 348. The lower seal 318 is shown contacting or supported by the shoulder member 236, and the retainer wire 310 retains the inner seal 306 and the retainer wire 320 retains the inner seal 316.

In operation, the conveyance 105 of FIG. 1 lowers the tool 104 toward the wellhead 115. In some embodiments, the tool 104 includes a running tool as well as the hydraulic tool 204 and sleeve and seal assembly 210 having the dual seal assembly 300. Once the hydraulic tool 204 and the sleeve and seal assembly 210 are run into position in the tubing/casing spool 202 as shown in FIG. 2, the hydraulic tool 204 is actuated to initiate a shifting or setting procedure for the sleeve and seal assembly 210 having the dual seal assembly 300. The inner sleeve actuator 208 produces a downward or setting force $F_1$ on the inner sleeve 214 (FIG. 3). The outer sleeve actuator 206 produces a downward or setting force $F_2$ on the outer sleeve 212 (FIG. 3). In some embodiments, the setting forces $F_1$ and $F_2$ are applied substantially simultaneously. The setting forces may also be referred to as loads elsewhere herein.

Figure 5:
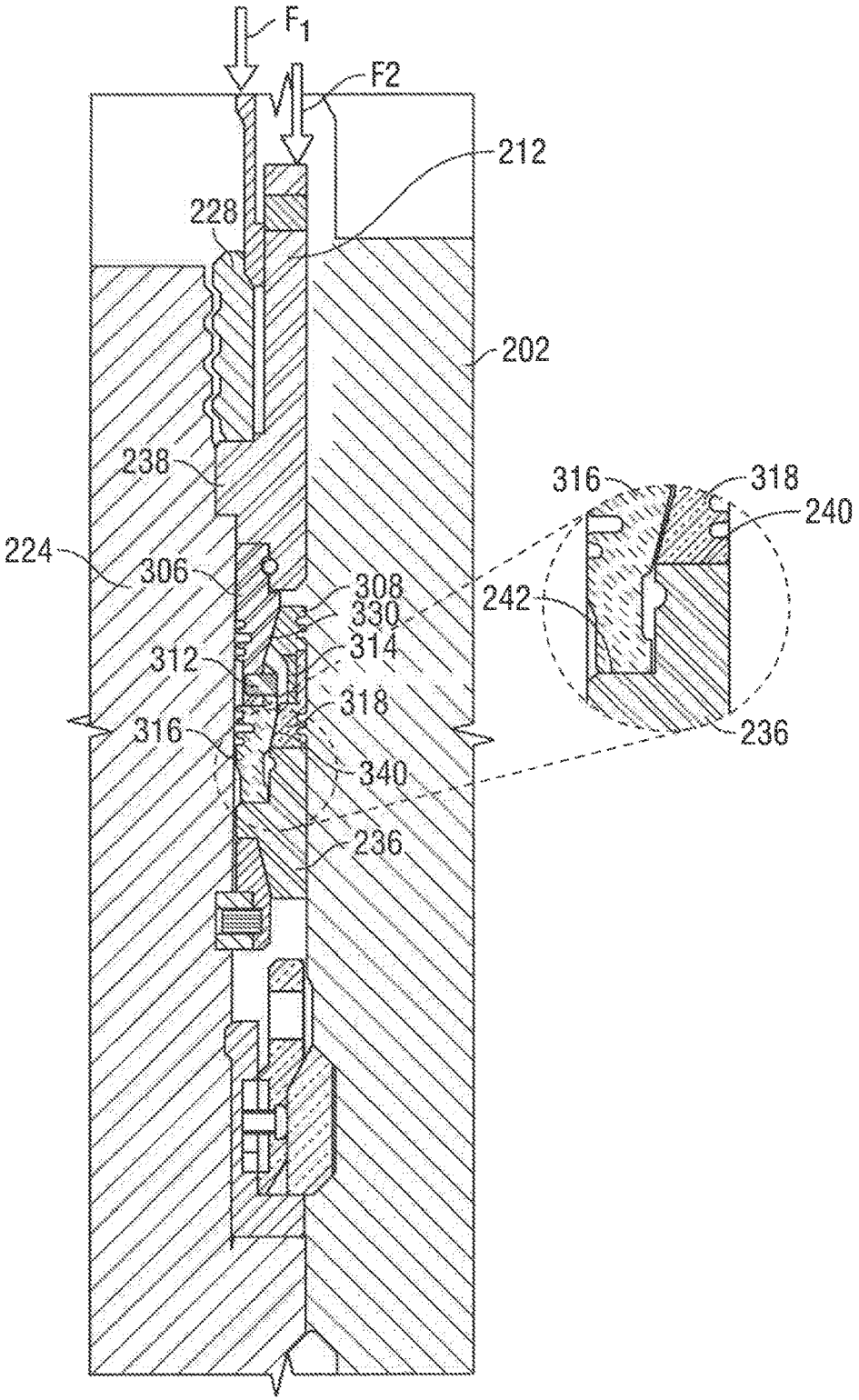
FIG. 5 is a view of the sleeve and seal assembly of FIG. 3 in an intermediate, setting position.

Referring now to FIG. 5, the setting forces, or loads, $F_1$ and $F_2$ cause an axially downward shift of the inner sleeve 214 and the outer sleeve 212. The load ring 228 will travel downwardly with the outer sleeve 212 as a result of the setting forces, though the load applied to the load ring 228 will include a substantial radial load as shown and described with reference to FIG. 6 below. A shoulder portion 238 of the outer sleeve 212 transfers these axial setting forces to the first inner seal 306, which then transfers the axial setting forces to the first outer seal 308. The upper seals 306, 308 then transfer the setting forces to the second or lower seals 316, 318. In some embodiments, various portions of the axial setting forces are transferred at the inner seal engagement interface 348 (i.e., directly between seals 306, 316) and via the support leg 314. In some embodiments, the upper seals 306, 308 directly transfer the setting forces to the lower seals 316, 318. In some embodiments, at least one of the upper seals 306, 308 is coupled to at least one of the lower seals 316, 318 such that the axial setting forces are transferred from the upper seals 306, 308 to the lower seals 316, 318 with the same setting motion that causes the setting forces. The setting forces cause a downward shift of the inner seals 306, 316 such that the lower seal 316 engages or "bottoms out" on a shoulder 242 of the shoulder member 236. While the lower seal 316 is bottoming out on the shoulder 242, the outer, lower seal 318 contacts or is supported by a shoulder 240 of the shoulder member 236. In some embodiments, one or more of the shoulders 240, 242 are tapered, thereby providing a tapered mating interface between the shoulders 240, 242 and the lower seals 318, 316, respectively. In some embodiments, the tapered seal and shoulder interfaces ensure that the lower seals 316, 318 are energized before the upper seals 306, 308. In other embodiments, the tapered seal and shoulder interfaces ensure that the lower seals 316, 318 are energized at the same time as the upper seals 306, 308.

As the inner seals 306, 316 move or slide downward relative to the outer seals 316, 318, as shown by the shift in position from FIG. 3 to FIG. 5, the tapered interfaces 330, 340 (see also FIG. 4) cause the outer seals 316, 318 to move radially outward or toward the tubing spool 202. Consequently, the outer sealing profiles 328, 338, respectively, can engage and seal against the tubing spool 202 as shown in FIG. 5. During this process, the seal 318 moves or slides along the tapered shoulder 240 while the seal 316 moves toward and bottoms out on the tapered shoulder 242. As noted above, the tapered seal and shoulder interfaces ensure that the lower seals 316, 318 are energized before, or at the same time as, the upper seals 306, 308 in certain embodiments. In further embodiments, the tapered seal and shoulder interfaces reduce the setting forces or loads needed to set the sleeve and seal assembly 210. In still further embodiments, the lower seals 316, 318 require less setting force than the upper seals 306, 308, thus the lower seals 316, 318 energize first.

Figure 6:
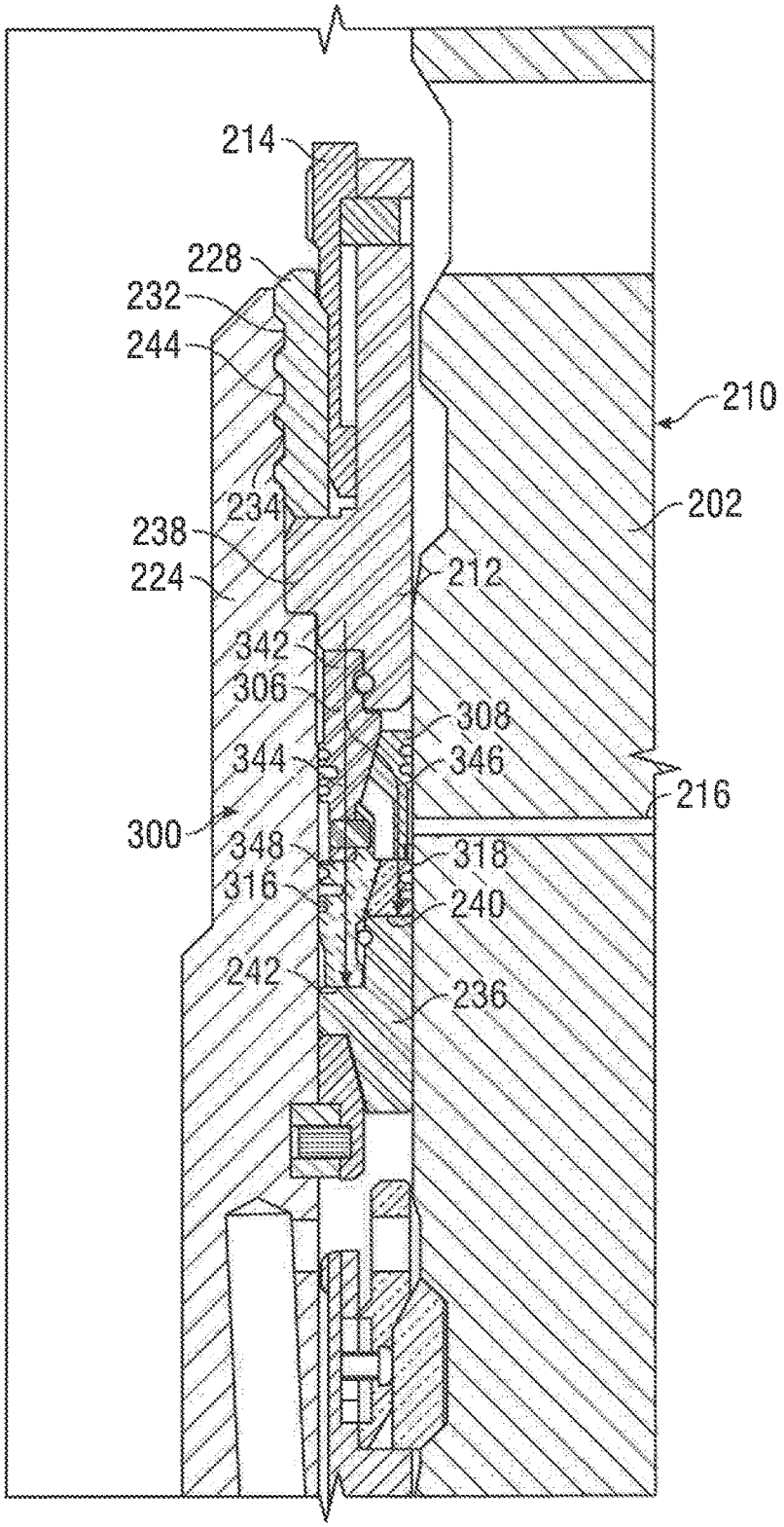
FIG. 6 is a view of the sleeve and seal assembly of FIGS. 3 and 5 in a final, set position.

Referring now to FIG. 6, the axial setting forces or loads $F_1$ and $F_2$ cause the sleeve and seal assembly 210 to achieve a final, set position. The inner sleeve 214 is moved axially downward to engage or lock the load ring 228. The engagement profile 232 of the load ring 228 is matingly engaged with the engagement profile 234 of the tubing hanger 224. The setting load is transferred from the shoulder portion 238 of the outer sleeve 212 to the upper, inner seal 306 along a load pathway 342. The load pathway 342 then extends down an inner load pathway 344 and an outer load pathway 346. In some embodiments, the inner load pathway 344 transfers directly from the upper inner seal 306 to the lower inner seal 316 across the inner seal engagement interface 348, and to the tapered shoulder 242. In some embodiments, the outer load pathway transfers directly from the upper outer seal 308 to the lower outer seal 318 and the tapered shoulder 240. Because of the similarly-angled tapered seal interfaces 330, 340, the outer seals 308, 318 slide axially and radially outwardly relative to the inner seals 306, 316. Thus, the setting load is also transferred to the outer sealing profiles 328, 338 (FIG. 4) to seal against the tubing spool 202, and to the inner sealing profiles 322, 332 to seal against the tubing hanger 224, while the seal assembly 300 is captured between the outer sleeve 212 and the lower shoulder member 236. In some embodiments, both sets of seals 302, 304 are energized with the same setting motion or sequence. In other words, the same setting motion or sequence establishes the load pathways 342, 344, 346.

Figure 7:
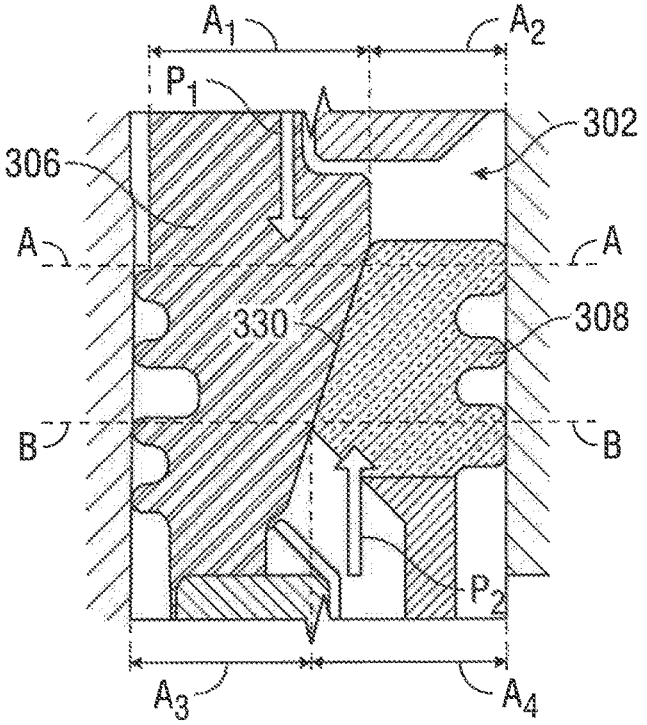
FIG. 7 is an enlarged view of the upper seal set of FIG. 6 with pressure enhancements.

Referring now to FIG. 7, an enlarged view of the upper set of seals 302 is shown. At a first radial plane A-A across the seal set 302 and the tapered interface 330 therebetween, a first radial sectional dimension or area $A_1$ associated with the seal 306 is greater than a second radial sectional dimension or area $A_2$ associated with the seal 308. At a second radial plane B-B across the seal set 302 and the tapered interface 330, a fourth radial sectional dimension or area $A_4$ associated with the seal 308 is greater than a third radial sectional dimension or area $A_3$ associated with the seal 306. Consequently, an increased or enhanced pressure $P_1$ acts across the seal 306 as shown in FIG. 7, and an increased or enhanced pressure $P_2$ acts across the seal 308.

Figure 8:
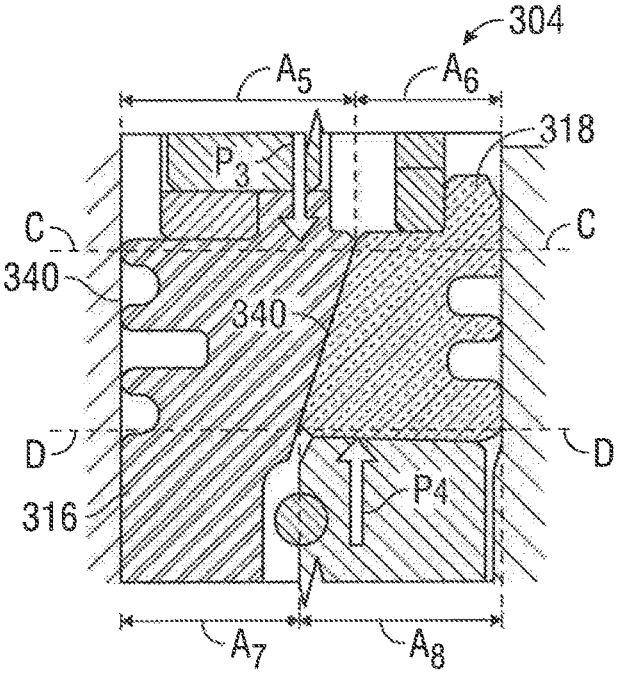
FIG. 8 is an enlarged view of the lower seal set of FIG. 6 with pressure enhancements.

Referring next to FIG. 8, an enlarged view of the lower set of seals 304 is shown. At a third radial plane C-C across the seal set 304 and the tapered interface 340 therebetween, a fifth radial sectional dimension or area $A_5$ associated with the seal 316 is greater than a sixth radial sectional dimension or area $A_6$ associated with the seal 318. At a fourth radial plane D-D across the seal set 302 and the tapered interface 330, an eighth radial sectional dimension or area $A_8$ associated with the seal 318 is greater than a seventh radial sectional dimension or area $A_7$ associated with the seal 316. Consequently, an increased or enhanced pressure $P_3$ acts across the seal 316 as shown in FIG. 8, and an increased or enhanced pressure $P_4$ acts across the seal 318.

Thus, due to the relative differences in areas across similar radial planes of the seal sets 302, 304 as just described, axial forces are translated into pressure enhancements $P_1$, $P_2$, $P_3$, and $P_4$ in four directions for the seal assembly 300. Thus, for example, a bore pressure may act on the upper seal set 302, such as by coming from downhole, up the casing, through the hanger and to the upper seal set 302. An annular pressure may act on the lower seal seat 304, such as by occurring between the casing and the housing in the event of a failed annular plug, cement, or other packoff assembly. Furthermore, in some embodiments, a test pressure may be applied through test port 216 between the upper seal set 302 and the lower seal set 304. Consequently, four pressures are acting on the seal assembly 300, with two acting opposite each other across the upper seal set 302 and two acting opposite each other across the lower seal set. Due to the relative differences in radial sectional areas across the identified planes in FIGS. 7 and 8, the noted resulting pressure enhancements $P_1$, $P_2$, $P_3$, and $P_4$ ensure that the effective force at those locations improves the sealing capability, or sealing wedge, of that portion of the seal assembly 300. In other words, the relative area designs of the seal sets 302, 304 manipulate pressures applied to the seal assembly 300 in order to supplement or enhance the sealing or wedging forces of the tapered seals.

Figure 10:
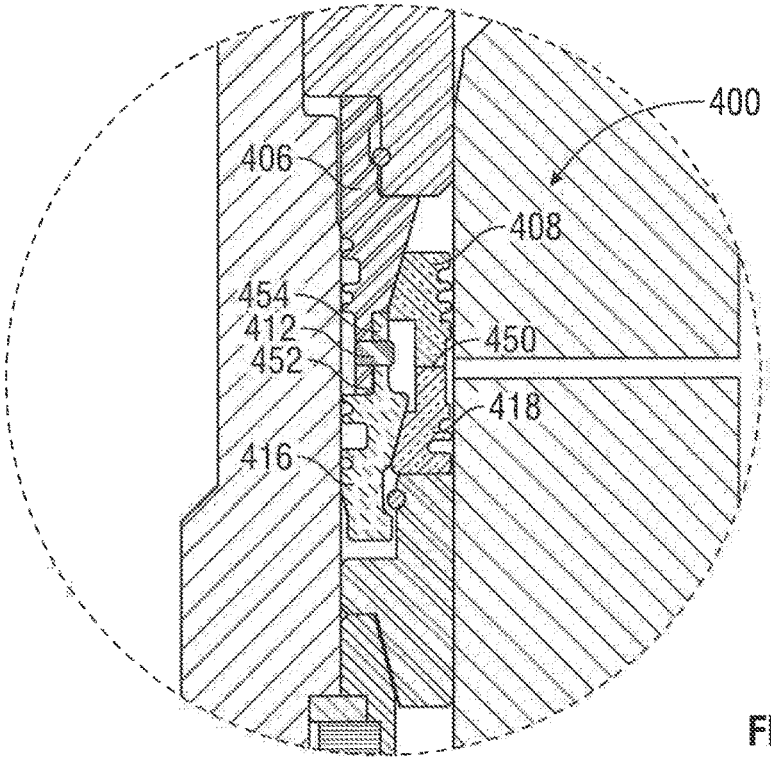
FIGS. 9 and 10 are cross-sectional views of an alternative seal assembly in accordance with principle disclosed herein.
Figure 9:
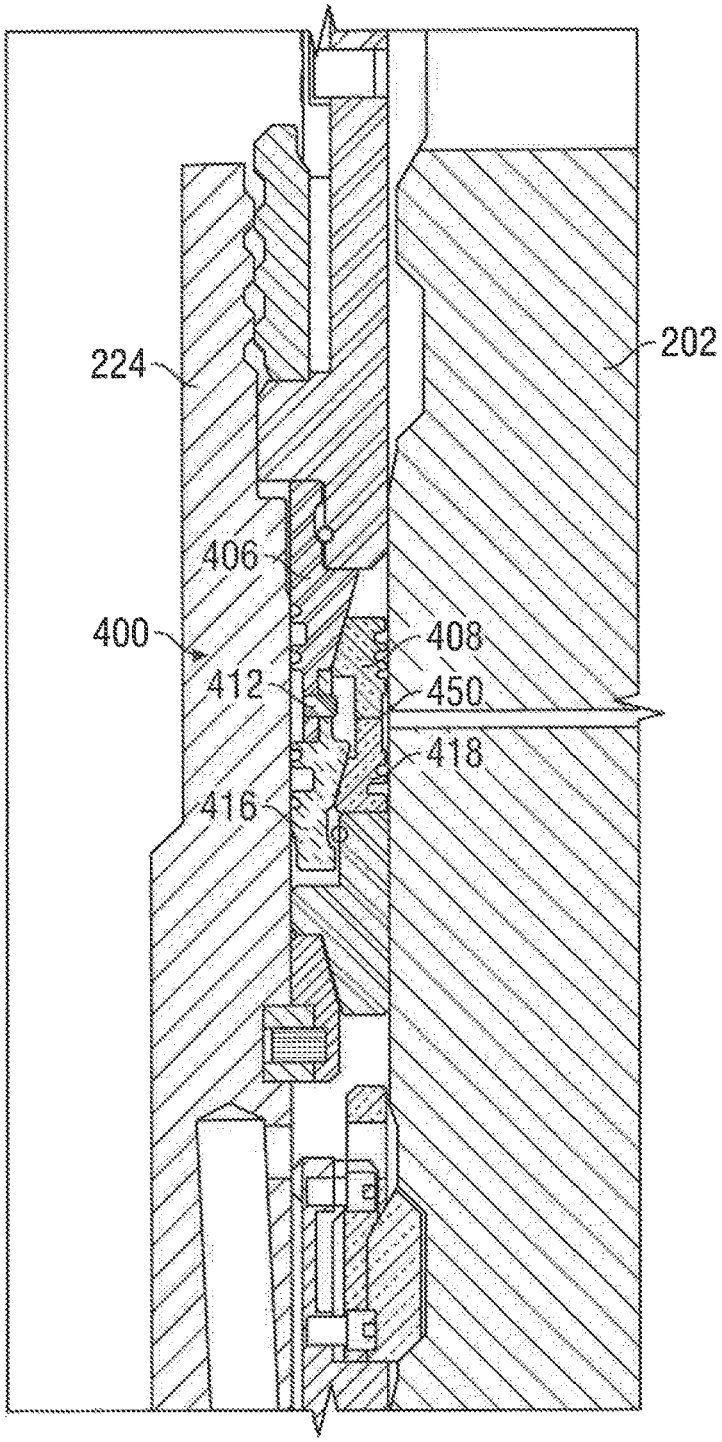

Referring to FIG. 9, an alternative embodiment of a seal assembly is shown disposed between the tubing hanger 224 and the tubing spool 202. A seal assembly 400 includes an upper, inner seal 406 and a lower, inner seal 416. As shown in FIG. 10, seal extensions 452, 454 of the seals 406, 416, respectively, are arranged to interface with a pin 412 in a slightly different manner as compared to the design of seal assembly 300 of FIG. 3. Further, an upper, outer seal 408 directly contacts a lower, outer seal 418 at a contact surface or interface 450 for axial support. In this embodiment, the support leg 314 is not needed. Other slight design changes can be seen in FIGS. 9 and 10, such as slightly different sealing profile surfaces, while many of the features of seal assembly 300 are unchanged.

Figure 11:
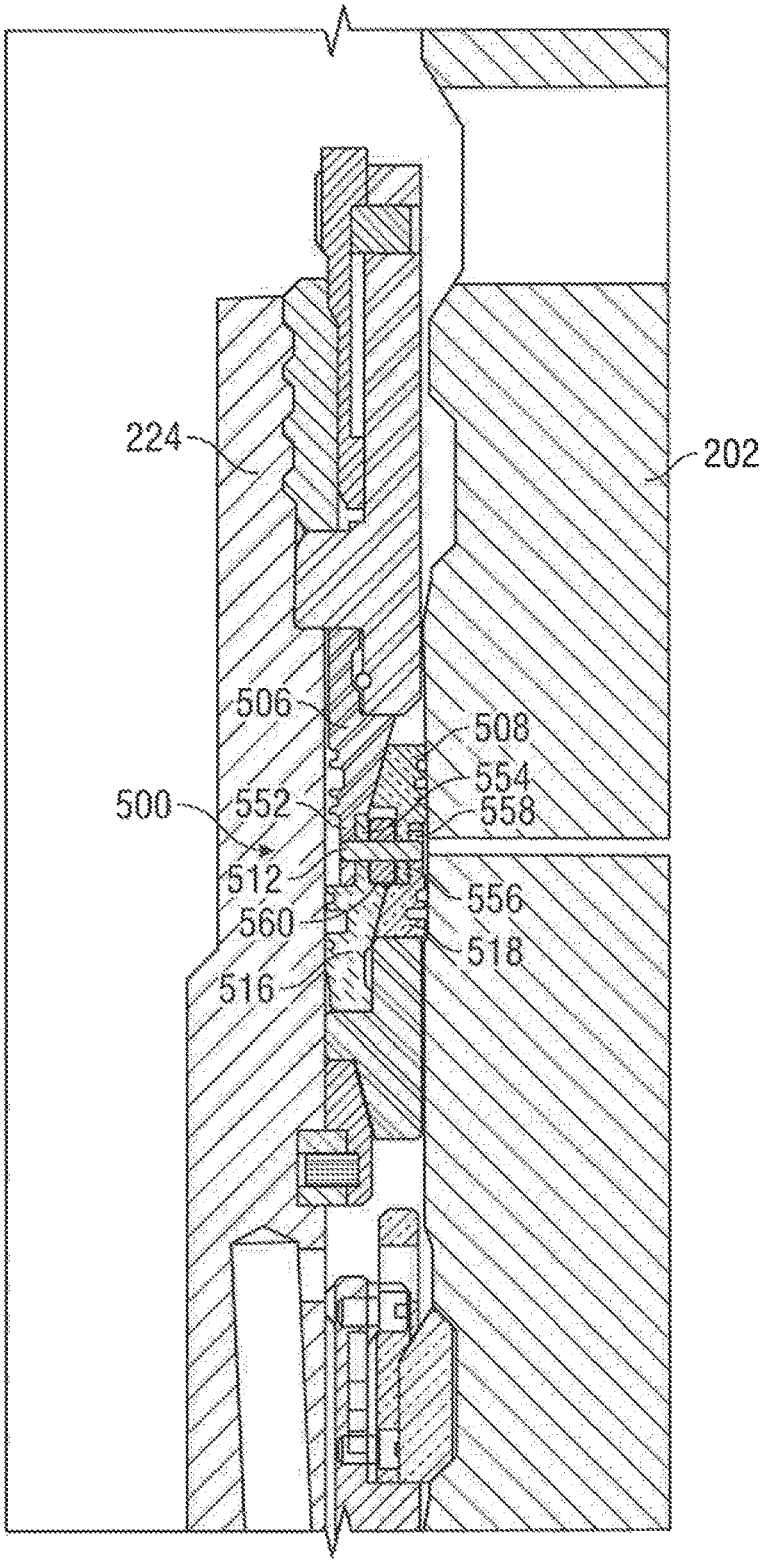
FIG. 11 is a cross-sectional view of an alternative seal assembly in accordance with principle disclosed herein.

Referring to FIG. 11, a further alternative embodiment of a seal assembly is shown disposed between the tubing hanger 224 and the tubing spool 202. A seal assembly 500 includes an upper, inner seal 506, a lower, inner seal 516, an upper outer seal 508, and a lower, outer seal 518. The seal assembly 500 shares many of the same features as the seal assemblies 300, 400, except for particular portions of the upper and lower seal interfaces. As shown in FIG. 11, a pair of inner axial seal extensions 552, 554 extends between the inner seals 506, 516. A pair of outer axial seal extensions 556, 558 extends between the outer seals 508, 518. An axial pin 560 is disposed between the seal extension set 552, 554 and the seal extension set 556, 558. A radial pin 512 is disposed through the axial pin 560, the seal extension set 552, 554, and the seal extension set 556, 558.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A tubing or casing hanger seal assembly comprising:
an actuation sleeve to be mounted on a tubing hanger;
a shoulder member to be mounted on the tubing hanger;
a seal assembly disposed between the actuation sleeve and the shoulder member, the seal assembly comprising:
a first set of seals engaged at a tapered interface; and
a second set of seals engaged at a tapered interface;
wherein, for each set of seals, a first radial plane across the set of seals and the tapered interface includes a radial sectional area of a first seal greater than a radial sectional area of a second seal, and a second radial plane across the set of seals and the tapered interface includes a radial sectional area of the second seal greater than a radial sectional area of the first seal.

2. The seal assembly of claim 1 wherein the tapered interfaces are disposed in the same direction.

3. The seal assembly of claim 1 wherein the tapered interfaces are parallel.

4. The seal assembly of claim 1 wherein the actuation sleeve is actuatable to energize the first and second sets of seals in a single setting motion.

5. The seal assembly of claim 1 wherein a load pathway extends from the actuation sleeve to the first set of seals, from the first set of seals directly to the second set of seals, and from the second set of seals to the shoulder member.

6. The seal assembly of claim 1 further comprising a pin coupled between a seal of the first set of seals and a seal of the second set of seals.

7. The seal assembly of claim 6 further comprising a support leg engaged between another seal of the first set of seals and another seal of the second set of seals.

8. The seal assembly of claim 1 wherein the shoulder member includes tapered shoulders to engage the second set of seals.

9. The seal assembly of claim 1 wherein the first set of seals is in direct contact with the second set of seals.

10. The seal assembly of claim 1 further comprising:
a tubing hanger; and
a hanger receptacle in a wellhead that receives the tubing hanger;
wherein the actuation sleeve, the shoulder member, and the seal assembly are disposed on the tubing hanger to capture the seal assembly between the tubing hanger and the hanger receptacle.

11. The seal assembly of claim 1 wherein:
the first set of seals comprises a first seal in contact with a second seal at the first tapered interface;
the second set of seals comprises a third seal in contact with a fourth seal at the second tapered interface;
the first radial plane across the first seal, the second seal and the first tapered interface includes the radial sectional area of the first seal greater than the radial sectional area of the second seal;
the second radial plane across the first seal, the second seal and the first tapered interface includes the radial sectional area of the second seal greater than the radial sectional area of the first seal;
the first radial plane across the third seal, the fourth seal and the second tapered interface includes the radial sectional area of the third seal greater than the radial sectional area of the fourth seal; and
the second radial plane across the third seal, the fourth seal and the second tapered interface includes the radial sectional area of the fourth seal greater than the radial sectional area of the third seal.

12. A tubing or casing hanger seal assembly comprising:
an actuation sleeve to be mounted on a tubing hanger and to provide a setting motion;
a shoulder member to be mounted on the tubing hanger;
a seal assembly disposed between the actuation sleeve and the shoulder member, the seal assembly comprising:
a first set of seals engaged at a tapered interface; and
a second set of seals engaged at a tapered interface;
wherein the first set of seals is coupled to the second set of seals such that the first and second sets of seals are energized by the same setting motion of the actuation sleeve.

13. The seal assembly of claim 12 further comprising a seal engagement interface disposed between the first and second sets of seals to directly transfer the setting motion from the first set of seals to the second set of seals.

14. The seal assembly of claim 12 further comprising a support member coupled between the first and second sets of seals.

15. The seal assembly of claim 12 further comprising a load pathway extending from the first set of seals through the second set of seals.

16. A method of actuating a tubing or casing hanger seal assembly comprising:
lowering a tool, sleeve, and seal assembly into a wellhead;
receiving the tool, sleeve, and seal assembly in a hanger receptacle in the wellhead;
actuating the tool to move the sleeve; and
energizing a first set of seals and a second set of seals in the seal assembly with the same sleeve movement.

17. The method of claim 16 wherein the first set of seals is an upper set of seals adjacent the sleeve, and the second set of seals is a lower set of seals disposed below the upper seals.

18. The method of claim 17 wherein the lower seals are energized before, or at the same time as, the upper seals.

19. The method of claim 17 further comprising energizing the lower seals against a tapered shoulder.

20. The method of claim 17 further comprising using a setting force to set the upper and lower seals, and wherein setting the lower seals uses less of the setting force than setting the upper seals.

21. The method of claim 16 wherein a seal of the first set of seals energizes a seal of the second set of seals across a seal engagement interface between the seals.

22. The method of claim 16 wherein each of the first and second sets of seals comprises a pair of seals with a tapered sliding interface therebetween, and sliding the seals in the same direction.

23. The method of claim 22 wherein a force applied from above and below each of the first and second sets of seals provides a sealing pressure enhancement above and below each of the first and second sets of seals.

* * * * *